US010975675B2

(12) United States Patent
Gonzalez Castillo

(10) Patent No.: US 10,975,675 B2
(45) Date of Patent: Apr. 13, 2021

(54) VACUUM GENERATOR DEVICE THROUGH SUPERSONIC IMPULSION FOR OIL WELLS

(71) Applicant: Jose Rafael Gonzalez Castillo, Houston, TX (US)

(72) Inventor: Jose Rafael Gonzalez Castillo, Houston, TX (US)

( * ) Notice: Subject to any disclaimer, the term of this patent is extended or adjusted under 35 U.S.C. 154(b) by 0 days.

(21) Appl. No.: 16/537,676

(22) Filed: Aug. 12, 2019

(65) Prior Publication Data

US 2021/0040828 A1 Feb. 11, 2021

(30) Foreign Application Priority Data

Aug. 9, 2019 (MX) ..... MX/a/2019/009556

(51) Int. Cl.
*E21B 43/12* (2006.01)
*E21B 43/18* (2006.01)

(52) U.S. Cl.
CPC ..... *E21B 43/18* (2013.01); *E21B 43/122* (2013.01); *E21B 43/129* (2013.01)

(58) Field of Classification Search
CPC ..... E21B 43/18
USPC ..... 166/372
See application file for complete search history.

(56) References Cited

U.S. PATENT DOCUMENTS 4,603,735 A 8/1986 Black
5,562,161 A * 10/1996 Hisaw ..... E21B 43/122 166/105
5,806,599 A * 9/1998 Hisaw ..... E21B 23/01 166/105
6,354,371 B1 * 3/2002 O'Blanc ..... E21B 43/124 166/154
7,063,161 B2 * 6/2006 Butler ..... E21B 43/122 166/372
7,066,268 B2 * 6/2006 Khomynets ..... F04F 5/464 166/372
7,909,089 B2 * 3/2011 Jackson ..... E21B 43/124 166/68
9,638,215 B2 * 5/2017 Burgess ..... F04F 5/46
2004/0113774 A1 6/2004 Davidian

* cited by examiner

*Primary Examiner* — Taras P Bemko

(74) *Attorney, Agent, or Firm* — Defillo & Associates, Inc.; Evelyn A Defillo

(57) ABSTRACT

A supersonic vacuum generator device for oil wells including: a cylindrical chamber; a suction device; a central accelerator core inside the cylindrical chamber; a tubular chamber connected to the cylindrical chamber, the tubular chamber including an internal fluid feed space; a concentric accelerator core inside the tubular chamber and connected to the central accelerator core, the concentric accelerator core includes a central vacuum tube having a cylindrical shape with a fluid accumulation chamber; a conical section connected to the fluid accumulation chamber and to a reduced diameter fluid passage that diverges with an angle range between 3.5 to 9 degrees with respect to a center line of the fluid passage; a one-way valve located on each one of the inlets of the central accelerator core; and a one-way valve located on the central vacuum tube.

4 Claims, 7 Drawing Sheets

Fiigure 4

VACUUM GENERATOR DEVICE THROUGH SUPERSONIC IMPULSION FOR OIL WELLS

OBJECT OF THE INVENTION

The object of the present invention is to provide a vacuum generating device for artificial lift by supersonic impulse in oil wells, which allows to increase the production flow. The best use of the conditions of the well/reservoir is to extract the crude oil, also allowing the optimization of the motor fluid, either gas, steam, or liquid, used for artificial lifting.

BACKGROUND

Within the oil industry, for precarious energy deposits, artificial lifting methods are applied, such as electro-submersible pumps, progressive cavity pumps, mechanical pumping, and highlighting. Among them: the artificial method for lifting gas (GL) and a jet accelerator. With these last two methods, and in common with any variation in well backpressure that negatively affects the volume to be produced, the depth of the gas injection point is contingent on the existence of GL mandrels or sliding sleeves. The gas consumption is high, and is affected by the water content, and definitely depends on the pressure of the reservoir to place the fluids on the surface. In particular, the GL method does not generate local vacuum and any gas injection pressure that exceeds the formation pressure causes the gas to be injected into the formation by impacting the production.

There are two types of accelerators: liquid-moving jet pump accelerators and gas-driven jet accelerators. For the gas-driven jet accelerators, injection levels must be controlled to not reach the speed of sound (subsonic flow), in order to avoid the formation of shock waves that reduce production. The gas-driven jet accelerators consume a lot of gas and are very sensitive to variations in the content of water in the well and backpressures. Finally, gas-driven jet accelerators are applicable to deposits with high productivity rates that do not work with gravity crude lifting well API<18.

Therefore, the production of oil by natural flow mechanisms does not guarantee obtaining cost-effective production levels during the productive life of the deposit, so it is essential to have pumps and/or artificial lifting systems to increase its production. Therefore, the present invention seeks to provide a lifting device for oil wells that allows to greatly optimize the production of them, in whose state of the art is the Chinese Publication No. CN201953533, which provides a conduction mode of a venturi tube and a fuel oil pump injection valve, including an oil tank in the form of a saddle, a main oil chamber, an auxiliary oil chamber, a double track turbine pump, an internal track oil outlet, an oil storage chamber, a venturi tube, an injection valve, and siphon tubes, in which the saddle-shaped oil tank is internally provided by the main oil chamber, the auxiliary oil chamber and the oil storage chamber. In addition, its output communicates with the venturi tube and the injection valve. The venturi tube is connected to the siphon tube arranged in the auxiliary oil chamber. The injection valve absorbs the fuel in the main oil chamber to the oil storage chamber.

Similarly, US Publication No. US2004118774 provides a liquid reconditioning system that separates the mixtures of two liquids that are insoluble from each other, such as the coolant and the oil trapped from a machining operation. The mixtures of the two liquids are delivered from a collection vessel to a separator by means of a venturi pump. In the same way, the invention provides a tank to contain the two liquids after they are separated, so they can be removed individually from the holding tank; one of the separate liquids, in the case of a refrigerant and residual oil, the refrigerant is pumped through the venturi pump to create the vacuum, or negative pressure, which extracts the mixtures of the two liquids from the sink to the separator. Also, the Korean Patent No. KR100756407 provides an oil pump that uses the venturi effect to simplify its structure and be conveniently used to generate oil suction force as soon as the air is discharged. Also collecting the oil in an oil collection vessel, minimizing the energy consumption by providing only compressed air in the oil pumping. The invention comprises a pump main body, a plurality of pipes in the first section, and pipes in the second section. The pump main body is shaped like a hexahedron and has a lower end inserted in an oil collection container. It also has an inner side equipped with an air passage connected to an air supply tube and on the other side connected to a silencer. The first pipes are formed so that the diameters gradually become narrower as the front is directed towards a higher end. The second pipes are installed inside a position of the silencer of the pump main body, so its rear end is adjacent to an upper end of the first ventilation tube.

French Patent No. FR2389761 provides a venturi pump that is installed in the engine refrigerant circuit, or in the engine lubricant circuit, to provide a vacuum level to activate the servo brake by vacuum. The pump operates without moving parts and therefore without wear. The system dispenses with the vacuum level of the inlet manifold, which is greatly reduced when exhaust emission controls are installed. On the other hand, U.S. Pat. No. 4,603,735 discloses an inverse upstream jet pump used in an oil and gas pumping system, which has a positive displacement pump on the surface that supplies water flow under pressure to the jet pump by one hole. The jet pump is used in a vacuum system that reduces, or almost eliminates, the effect of load pressure inside the well, resulting in a freer fluid flow to reduce costs and increase production. The water is fed down through a more internal pipe to a plurality of water flow deviation lines just above the jet pump body that directs the flow of water to and through a plurality of water flow openings extended up and down the body of the jet pump. Also from bottom to top by a water flow inversion cap that inverts the water flow and directs the water flow upwards through a central opening that narrows for an accelerated water flow towards and through a venturi chamber that has an inlet side vent for a vacuum effect that extracts fluids and/or gases from the well. The housing and the formation in the water flow stream for passage from the jet pump body towards the top and towards the top of the pipe is larger and concentric enclosing the innermost pipe.

On the other hand, the Mexican Patent Application No. MXPA04003902 discloses a hydraulic jet claw pump BCL-1 used to extract oil from the subsurface using the venturi principle and a working fluid (high pressure injected oil, water, or other product) that includes 19 static parts, in which the following elements are being altered: fishing collar, nozzle housing, outer tube, discharge body, extension adapter, and bottom retainer.

Compared to the state of the art, the present invention differs widely in its structure and results obtained once it is installed in an oil well. In addition, it bases its efficiency on the use of the kinetic energy of the lifting motor fluid, promoting the mixing of fluids with high efficiency and high energy transfer, and using the speed increase at supersonic level, to generate the sustained suction (vacuum effect) at the bottom of the well. In addition, it can be installed in the production pipeline and decreases the flowing bottom pressure (Pwf), increasing the well's production rate according to the productivity rate.

It should be noted that it applies for gravity crude API, crude with gravity API greater than 14. Its productivity index (IP)>0.3 BPD/PSI is not limited by the depth of the well, allowing a high handling capacity of the water/sediment content (W/S %). In the same way, it stabilizes the fluid column, eliminating the "pitching" of the well, and decreasing the motor fluid consumption. In addition, the present invention is installed in the circulation sleeves or padlocked sleeves (lock mandrel), in mandrels, and holes between gaskets (pack-off) using a steel/slick-line line unit (wire line/slick-line), portable flexible pipe unit or a coiled tubing. It does not require the installation of additional surface facilities, uses the same system for the management of the existing motor fluid (gas), and has a design adjusted to the particular conditions of each well/site.

In addition, the proposed invention, the arrangement of the substantially cylindrical chambers or with profiled chambers with functions based on conical-derived functions, the sound barrier is overcome by operating at supersonic speeds generating vacuum levels highly stable and substantially proportional to the volume of the injected gas. In addition to the productivity being determined by the same well, the well production is insensitive to change in backpressure and water content. It stabilizes substantially the pressure of the system, avoiding the generation of fatigued battering formation, and the gas injection point can be lowered to where required or permitted by the design of the well completion. In addition, it allows the use of the steam as a driving fluid, without being injected into the formation to protect the rock matrix, having as its second function the heating of the rock and the fluids of the formation, substantially by conduction and thermal convection. The fluids are sucked and reheated incrementally along their water path below the producing area to the surface, by heat transfer, by thermal conduction between the steam injected by the annular production space and/or concentric pipe, is installed interchangeably with fine steel/wire line unit (wire line/slick-line), portable flexible pipe unit, or portable coiled tubing unit (coiled tubing). Finally, the cost benefit of the increase in the gas consumption versus expected production is more economically attractive compared to the use of previous technology.

DETAILED DESCRIPTION OF THE INVENTION

Figure 2:
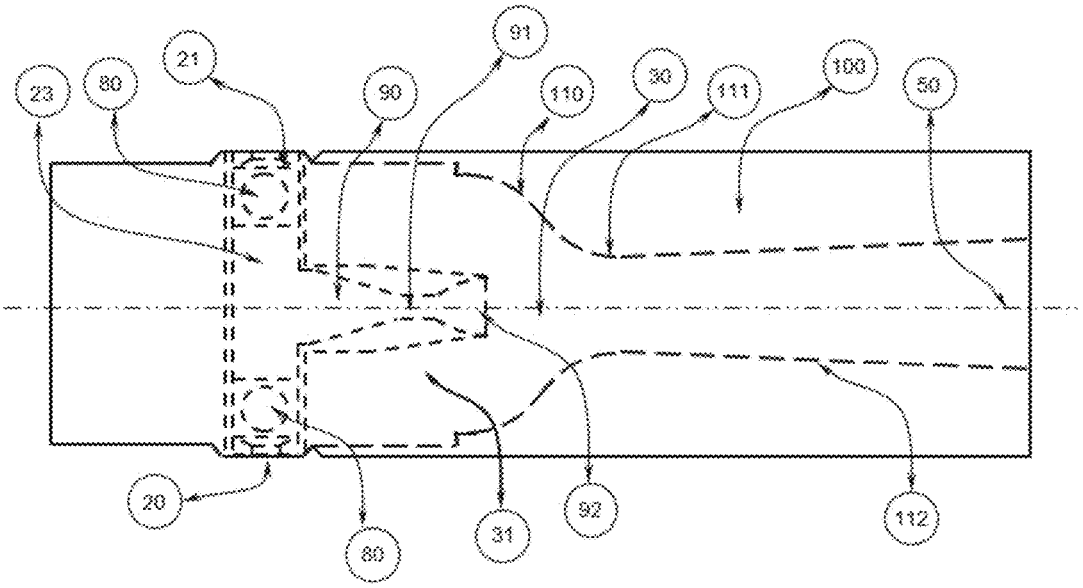
FIG. 2 shows a side view of the inside of the central accelerator core array inside the central vacuum tube.
Figure 3:
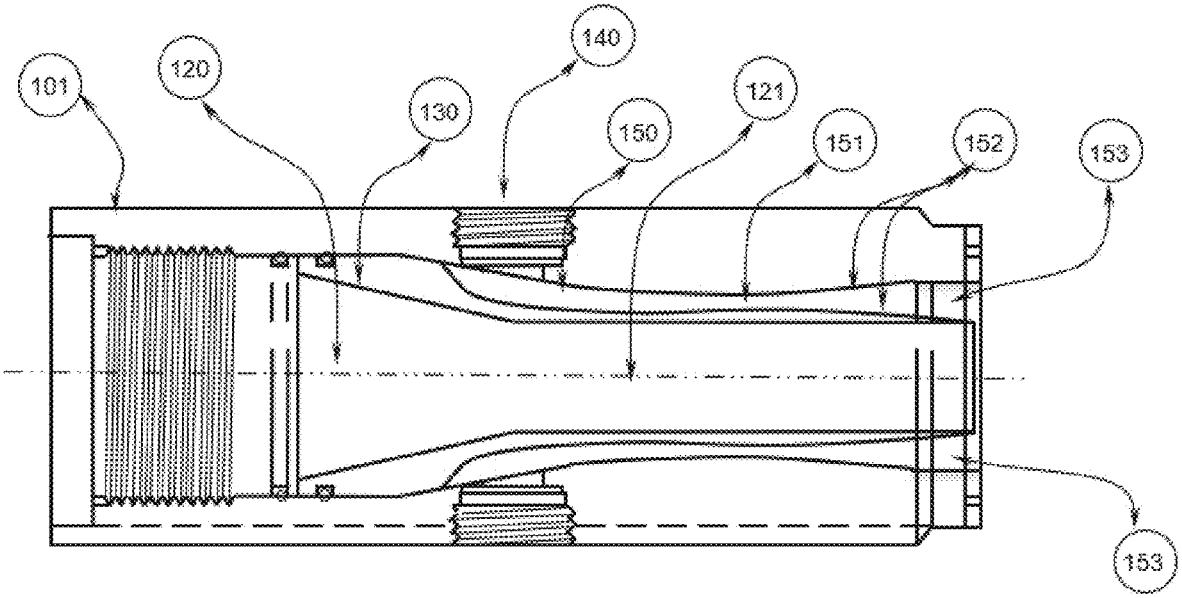
FIG. 3 shows a side view of the inside of the arrangement with concentric nozzle core and vacuum chambers and formed between the space in the space.
Figure 5:
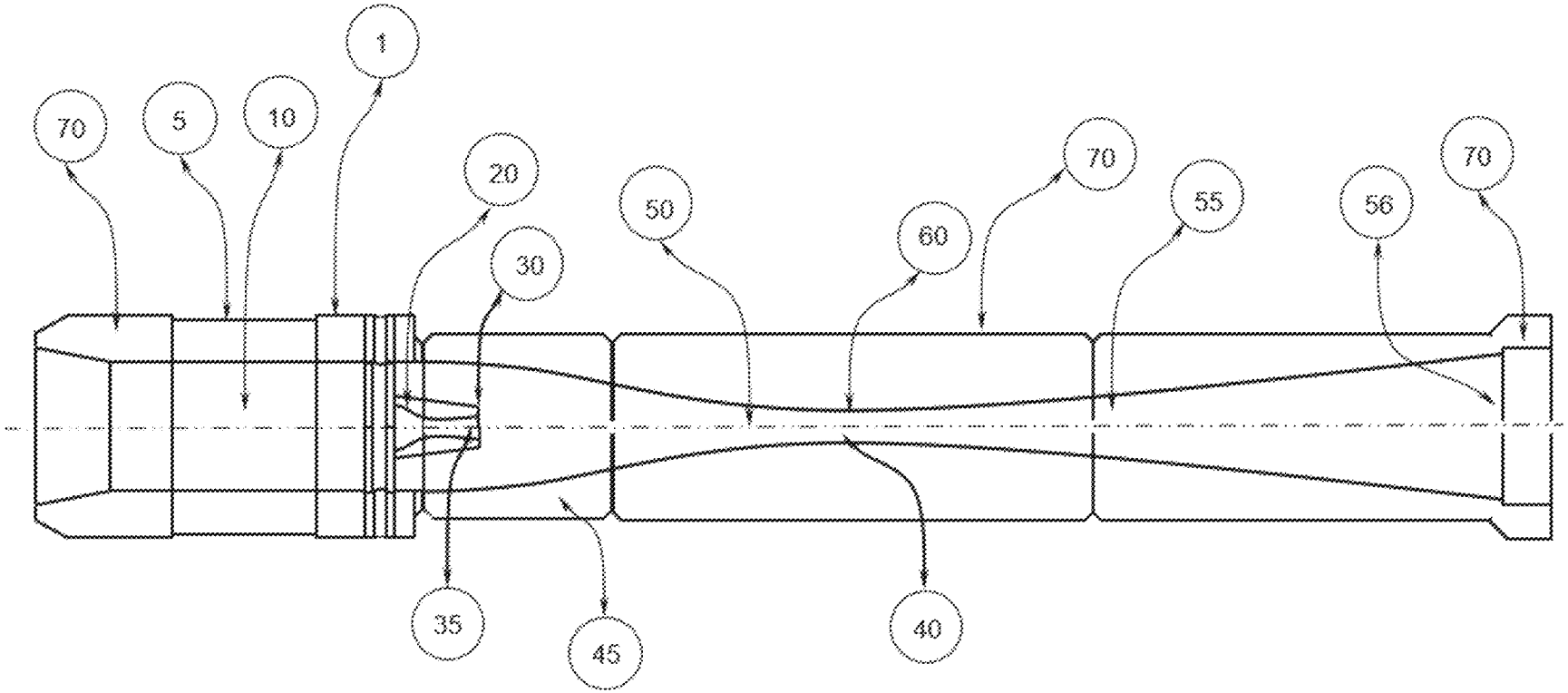
FIG. 5 shows a side view of the present invention with central arrangement and divergent tube.

The device object of the present invention, as shown in FIG. 5, includes a substantially cylindrical chamber (60) that inside has a core, which is chosen from a central accelerator core and a concentric accelerator core, shown in FIG. 2 and FIG. 3, respectively. The chamber (1) is a tubular element device protector of the device (70) and has an internal fluid feed space (10) for the fluid to be impulse, a central accelerator core (20) and/or a concentric accelerator core (130). Said accelerator core is a convex core convergent that connects a cylindrical convex passage and at the end of it with another divergent flux and convex passage, in which the shock waves appear. The mixing of the impeller fluids begin and are accelerated at supersonic speeds to penetrate a divergent convergent zone of sinusoidal profile (50), where the mixing and kinetic energy transfer takes place until proceeding with a substantially cylindrical-conical internal zone (56), where the conversion of kinetic energy to potential energy occurs. The central accelerator core is located inside a central vacuum tube, as shown in FIG. 2.

The device (70) is characterized by being tubular insertable for the suction and the impulsion of low-energy fluids, substantially of a concave-convex-cylindrical interior and (40), (100) and/or (101), as shown in FIGS. 2, 3 and 5. This includes an internal arrangement, either concentric or central, including a central accelerator core (20) and/or concentric accelerator core (130), whose internal and external geometry is of the convex-concave-sinusoidal type and which accelerates a drive fluid such as gas, water, oil, solvent, water vapor, or nitrogen supplied at high pressure until reaching supersonic speeds and shock wave-generating speeds in a central accumulation chamber (35) or concentric (153), where the fluid to be impulse penetrates, invading the acceleration zone, generating pre-mixing and kinetic energy transfer with the fluid impeller to a speed higher than the speed of sound.

Figure 1:
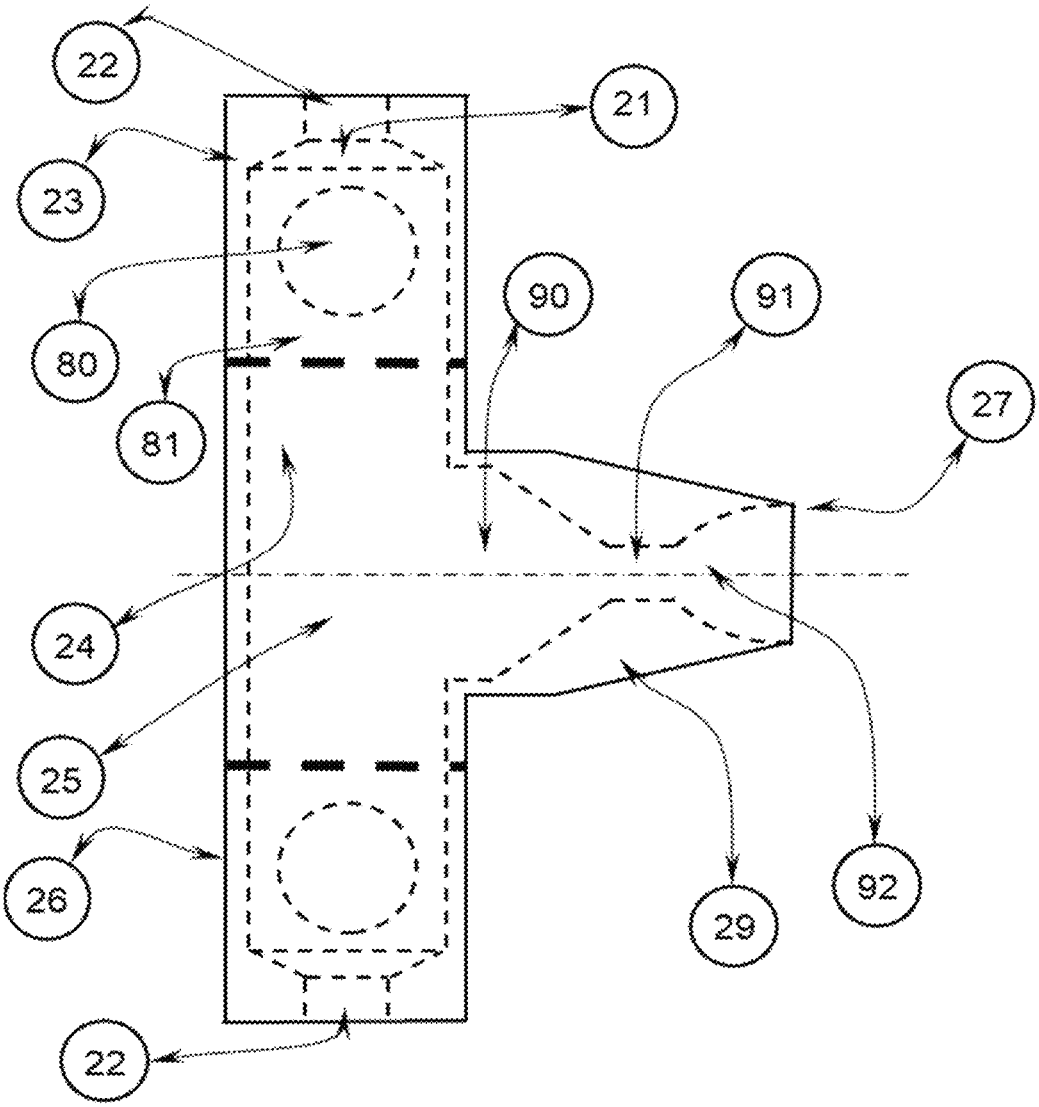
FIG. 1 shows a side view of the inside of the central accelerator core where its elements are visible.

The central accelerator core (20) or low-energy fluid drive core, or to be driven, is an element comprising of at least one passage or fluid inlet port (22) called drive and an output (27) comprising of at least one section substantially tubular section (23) of substantially cylindrical inner section (24) of average diameter of ¼ to ⅝ times the inner diameter of the passage (10), as shown in FIG. 5, and/or substantially cylindrical external section (26) and/or aerodynamic profile, which converge in a radial way. As shown in FIG. 1, forming a central chamber (25) of accumulation of impulsion fluid to which is connected another section (29) of substantially tubular external transverse area and longitudinal external profile and longitudinal and substantially conical-derived and/or concave forming an inner passage that communicates to another substantially cylinder-converging passage (90) conical-derived and/or concave profile of longitude equivalent to three to nine times the inner diameter of the passage (91), a strangulation passage (91) of cylinder-convex section and a substantially conical-derived, cylinder-derived, straight and/or concave-divergent section passage (92), whose length is three to seven times the internal diameter of the passage (91) and whose diameter at the output (27) is between the range of 7/3 to 13/2 times the inner diameter of the passage (91). Such passages (90), (91), (92) are profiled and machined without bumping one after the other. At each inlet (22) there is a one-way valve consisting of a substantially spherical solid device (80), substantially spherical solid device seat (21) and at least one pin (81) retaining a substantially spherical solid device.

The central vacuum tube (100), shown in FIG. 2, is a substantially externally cylindrical tubular device including a fluid accumulation chamber (31) with convergent sump-type profile (110) of derived profile by the functions conical, that directs the fluid to centrally push towards the output (30) of the central accelerator core. It also includes a throat (111) connected to a convex cylinder manner to a fluid passage (50) that diverges with an angle range between 3.5 to 9 degrees with respect to the center line or axis. The divergent profile (112) is substantially cylindrical straight and/or convex that depends on the volume of fluid to be handled by this invention, in accordance with the laboratory observations described by the equation b/a=0.889+0.0449L/a; where L is the distance ratio or nozzle separation to the throat (111) and the diameter of the output (30). The length of the profile (112) is 1.5 to 30 times the inner diameter of the throat (111).

The accelerator core (20) is located in such a way that the distance between the output (30) and the arc distance between the converged sink profile (110) and the throat (111) generates a flow area that is 0.75 to 1 times the annular area between the internal diameter of the section internal feed space (10), as shown in FIG. 5, and the outer area of the nozzle (29) measured in the section of intersection with the tubular (23). In this way, the flow of fluid to be driven recirculates in the space between the output (30) and the output (30) to the interior (92) to be driven at supersonic speed by the driven fluid towards the throat (111). From there towards the passage (50) where the transfer of momentum is finished from the driven fluid by the mixing phases and a deceleration of the mixture occurs with the subsequent increase in pressure by conversion of kinetic energy to potential.

As shown in FIG. 3, the present invention also comprises an element comprising a one-way inlet valve (140) of tongue type with a check mounted on the concentric vacuum tube (101). Said element constitutes a flow passage of which, in the case of high volume, constitutes inside a fluid passage having a substantially cylindrical-straight-conical (120) for fluid acceleration to be driven, followed by a flow passage (121) having a substantially cylindrical convergent-guiding. On the outside it has a sinusoidal surface section (152) having a high wavelength for the development of a fluid supersonic velocity that enters through the unidirectional valve (140) towards the fluid accumulation chamber (150) formed between the concentric space that exists between the curve (152) of the concentric nozzle core and the profile (152) of the internal surface of the vacuum tube (101), which is positioned axis-symmetrically with respect to the axis of the central core leaving, in the neck region (151), a flow passage space that follows the same criteria as for the central accelerator core is 2⅓ to 6½ lower than the output area (153) of the supersonic flow.

This arrangement with concentric accelerator core (130) and concentric vacuum tube (101) forms vacuum chambers (152), (153) coupled directly to the input of the divergent nozzle section (60), shown in FIG. 5.

Figure 4:
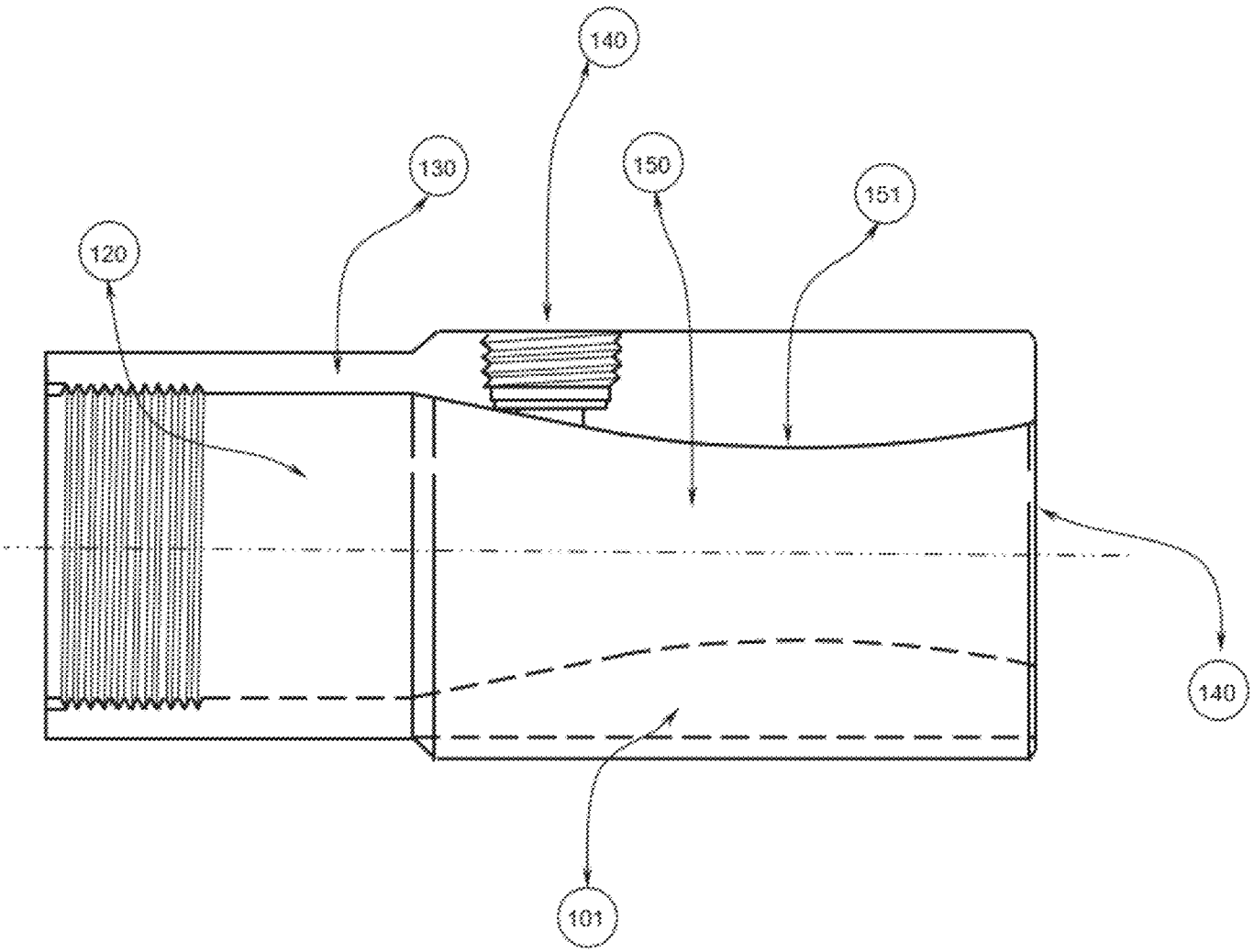
FIG. 4 shows a side view of the inside of the concentric vacuum tube.

A concentric vacuum tube (101) optionally replaces the central vacuum tube (100) when high flow volume handling is required. This comprises a fluid feed face (10), which is a substantially cylindrical straight section that is connected to a convex section (150), shown in FIG. 4, including a sinusoidal curvature (151) of a high wavelength with respect to the central axis of the device, which is directly connected to the output (121) with the section (60) shown in FIG. 5. The surface (151) is designed according to a mathematical model using profiles derived from the conical functions, which adjusts the supersonic flow pattern to the magnitude of the vacuum to be generated, which depends on the characteristics of the fluid to be produced and to the well flow conditions.

It should be noted that the present invention is based on a mathematical model developed for the supersonic regime, which allows an exclusive design of the internal spaces with a geometry appropriate for said regime. In the same way, it exceeds the regime of speeds to where available pressure from surface drive fluid allows values far higher than the speed of sound. This makes it possible to extend the range of vacuum and drive generation. The range of water content and backpressure generated downstream of the system also has the ability to lower the injection point of the impeller fluid and starts by moving the fluid column within the well production pipe with the same lifting gas previously calculated and dependent on well conditions, using steam as a drive fluid, which enables it, advantageously and economically, for the pumping and extraction of heavy crude training.

In addition, the present invention allows the use of injected steam, as a source of thermal heat transfer incrementally from the bottom to the surface by conduction. This allows to further decrease the losses by viscous dissipation to the surface and is surface-level installable for transferring fluids from flow lines and to decrease the inlet pressure to separator tanks in order to further reduce the backpressure in the wellhead.

Example 1. Operation of the Present Invention

The drive fluid, gas, liquid, vapor from any source, whether the production of annular space, pumping unit or gas compression unit, enters through the fluid inlet ports (22) to the central accelerator (20). The fluid (gas, liquid, or vapor) moves the substantially spherical solid device (80) by separating it from the sphere seat (21) and supporting it against the pins (81) to constitute a fluid flow to the fluid accumulation chamber (25), where it is compressed and forced to move towards the cylinder-converging passage (90), where the conical-concave inner profile causes the fluid to accelerate to speed values close to the speed of sound. Subsequently, the accelerated fluid, as described, continues to move to the cylinder-convex section (91), where it finishes reaching the speed of sound and is forced to pass towards the cylinder-conical-divergent section passage (92), where, by geometric effect, is accelerated to values higher than the speed of sound exceeding the supersonic barrier to move, finally towards the output (27). For gas, the entire process is isenthalpic in nature.

Depending on the magnitude of the speed achieved, oblique shock waves are presented in this section which, by the nature of their conformation, contribute to generate substantially low pressures, or sustained vacuum. When shock waves occur inside the passage (92), the fluid surrounding the central accelerator (20), called driven fluid, tends to invade the inside of the passage (92). As a result of the vacuum generated by the high speed inside the passage (92), the driven fluid is immediately captured and dragged by the drive fluid particles, which transmits its impulse, accelerating it to speeds close to the speed of sound. The pressure in this area is substantially lower than that of any area of the invention.

Figure 6:
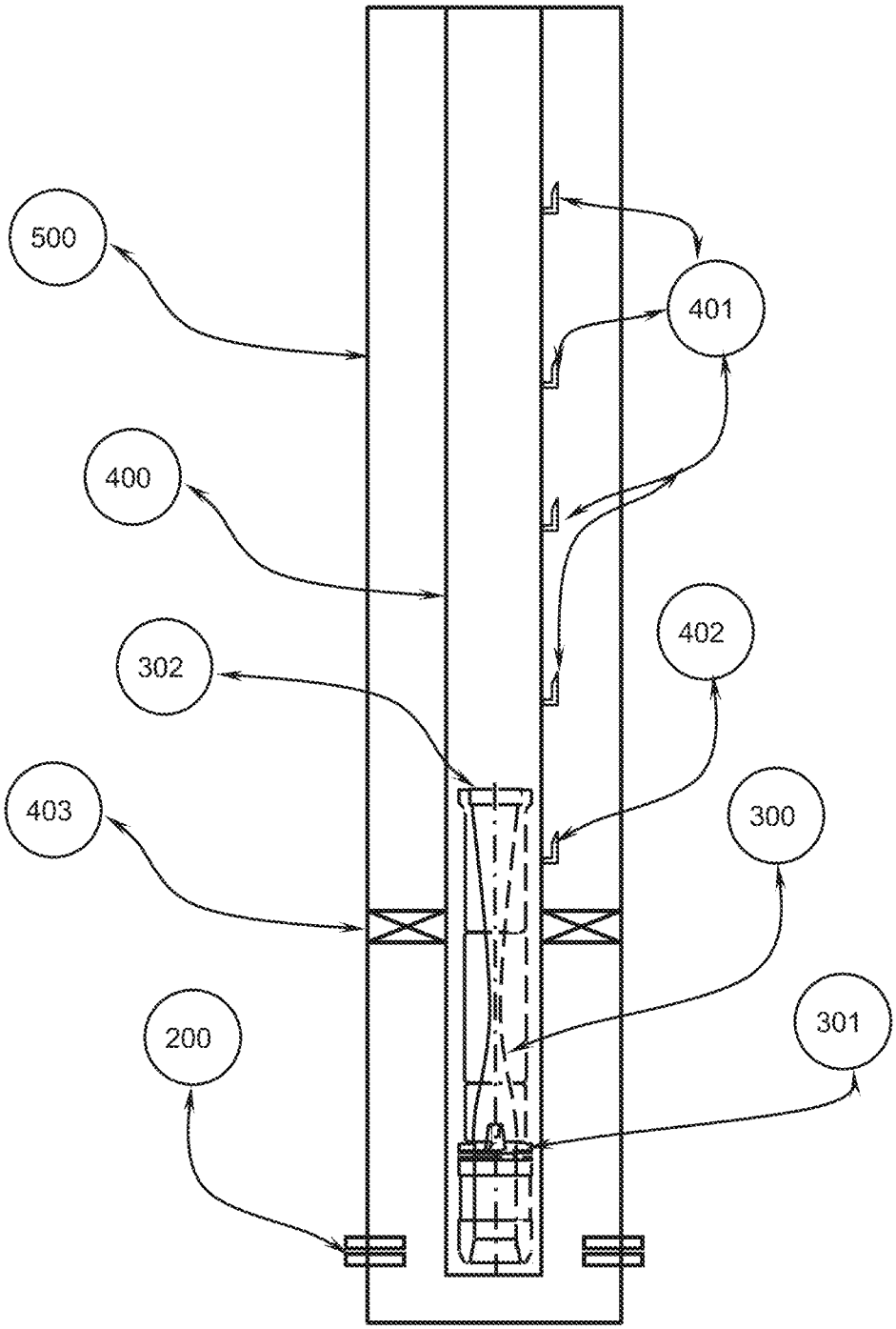
FIG. 6 shows a schematic frontal view of the installation of the invention at lower injection points.

Example 2. Installation Scheme of the Present Invention in Lower Points of Injection FIG. 6 shows a schematic of a generic well showing the production liner (500), the production pipe (400) the GL mandrel, hole, or sliding jacket located at the deepest GL gas injection point (402).

The present invention has a clamping device or anchor that allows to isolate the current injection point of GL and divert it to the point (301) located in front of the perforations or area of fluid intake from the reservoir to the well (200); scheme not covered by the previously mentioned inventions.

In the case of using vapor as a drive fluid, this system also allows to heat the formation by heat transfer predominantly by conduction and to generate a constant high temperature area along the production pipe, improving as time passes the factor of recovery of the formation and without having to inject the vapor into the formation. It is achieved with the latter, to preserve the rock matrix from irreversible damage from the process of steam injection to the formation.

Example 3. Evaluation in the Field of the Present Invention

Figure 7:
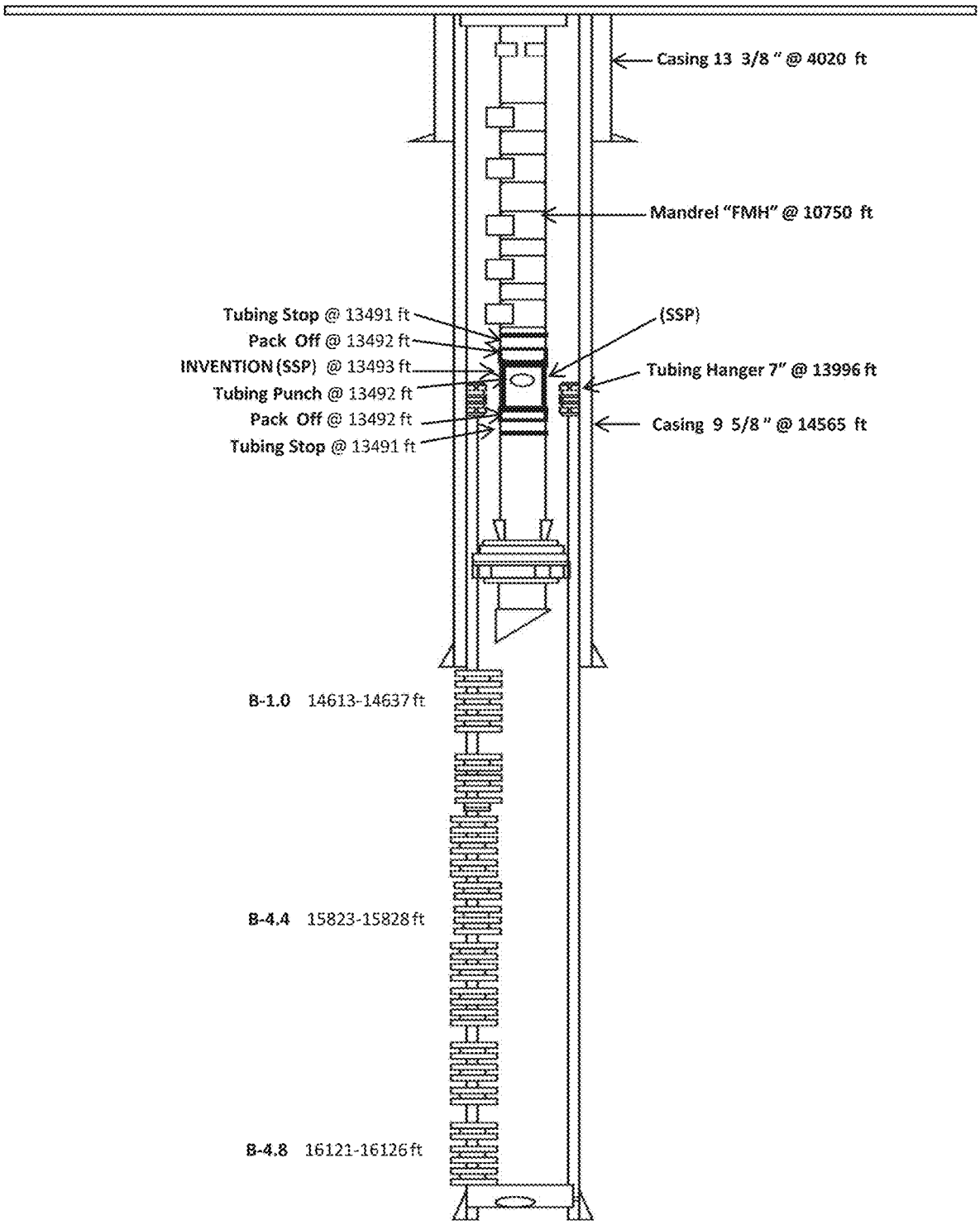
FIG. 7 shows an internal view of a well, including the device of the present invention.

The present invention was validated in the Ceutatreco field located in Block VII of Lake Maracaibo, in the well VLG-3875 producer of crude 20.7° API, using artificial lift gas, achieving a production increase from 40 to more than 85%. With for what was achieved with the optimized Artificial Gas Lift (GL) technique, the mechanical diagram data can be seen in FIG. 7, and the well data is specified in Table 1:

TABLE 1

| Well/Deposit Data | | |
|---|---|---|
| API | 20.7 | |
| W/S % | 36 | |
| Asphalt/Paraffin | No | |
| Production | 640 | Bbpd |
| IP= | 1.69 | Bpd/Psi |
| Pwf (15385 Ft) | 1860 | Psig |
| Pres Estat.= | 2300 | Psig |
| Bottom Temp. | 30° | F. |
| Depth | 15385 | ft |
| THP | 120 | Psig |
| CHP | 960 | Psig |
| Gas Form (GS) | 0,79 | |
| Gas Form | 350 | Mpcsd |
| Iny Gas (GS) | 0.78 | |
| Iny Gas | 1500 | Mpced |
| Pres Iny. Gas | 960 | Psig |
| Prof Iny Gas | 13500 | ft |
| Depth | −15000 | ft |

Figure 8:
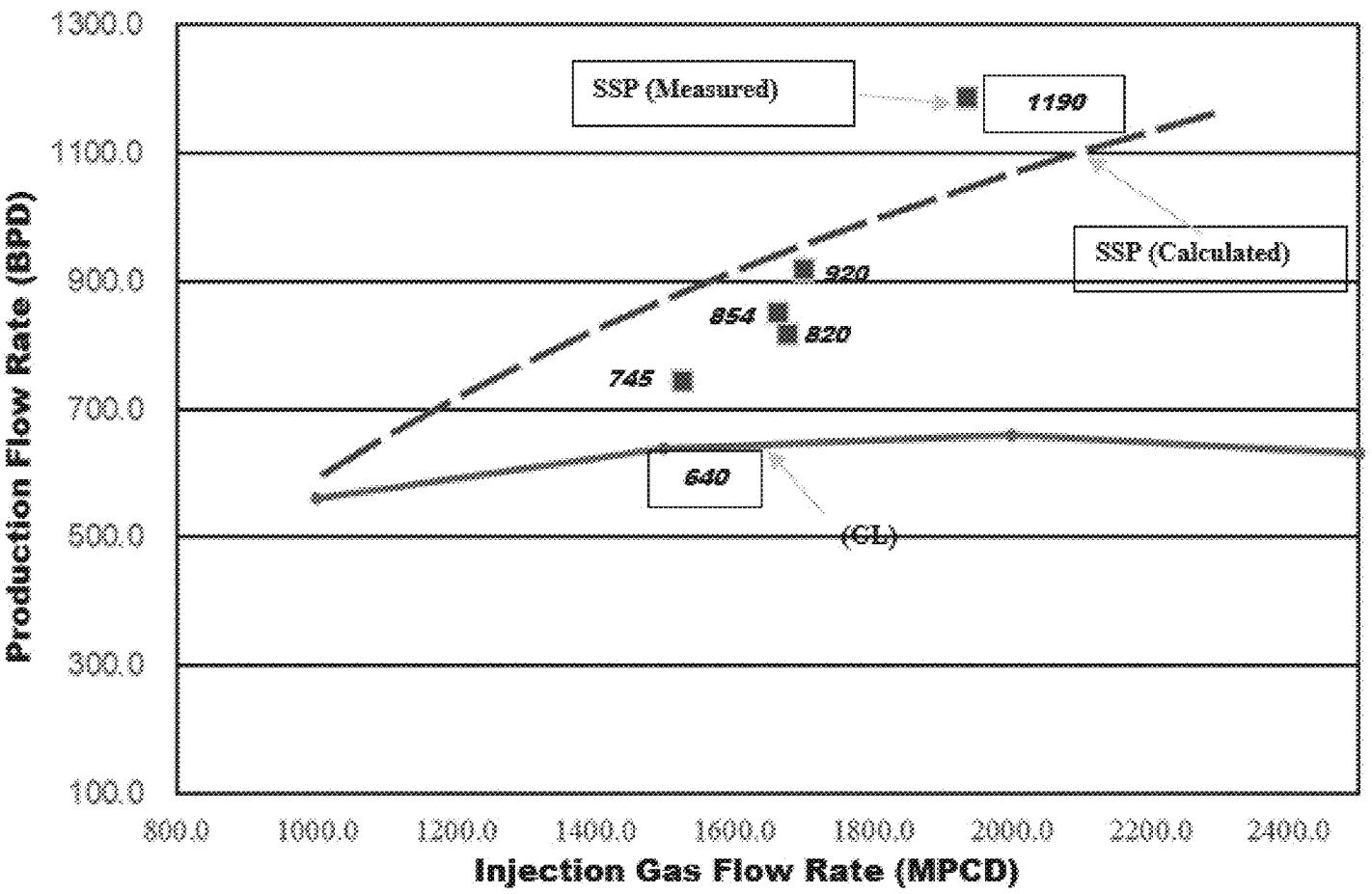
FIG. 8 shows a graph with the comparative results between Artificial Gas Lift (GL) and the present invention.

On the other hand, FIG. 8 details a graph with the comparative results between Artificial Gas Lift (GL) and the present invention, in which an increased production is seen: 85.9% (1190 vs 640 BPD) and the decrease of gas injection of 27% (410MPCD).

Having sufficiently described my invention, I consider it as a novelty and therefore claim as my exclusive property, what is contained in the following claims:

The invention claimed is:

1. A supersonic vacuum generator device for oil wells comprising:

a cylindrical chamber having a first end, a cavity, and a second end;

a suction device connected to the first end of the cylindrical chamber;

a central accelerator core located inside the cavity of the cylindrical chamber, the central accelerator core includes an inlet port, an outlet port, a cylindrical inner section located near the outlet port, the cylindrical inner section is perpendicular to the outlet port of the central accelerator core, the outlet port of the central accelerator core has a first internal conical section, a second internal conical section, a cylindrical section having a reduced diameter placed between the first and the second conical sections, the cylindrical section is connected to the respective small ends of each one of the first and second internal conical sections;

a tubular chamber connected to the second end of the cylindrical chamber, the tubular chamber including an internal fluid feed space;

a concentric accelerator core located inside the tubular chamber and connected to the outlet of the central accelerator core, the concentric accelerator core includes a central vacuum tube having a cylindrical shape with a fluid accumulation chamber, a conical section having a first end connected to the fluid accumulation chamber and a second end connected to a reduced diameter fluid passage that diverges with an angle range between 3.5 to 9 degrees with respect to a center line of the fluid passage;

a one-way valve located at the inlet port of the central accelerator core; and a one-way valve located on the central vacuum tube.

2. The supersonic drive vacuum generator device according to claim 1, wherein the first internal conical section of the outlet of the accelerator core has an inner diameter that is three to nine times an inner diameter of the cylindrical section of the outlet of the accelerator core.

3. The supersonic drive vacuum generator device according to claim 1, wherein the second internal conical section of the outlet of the accelerator core has a length that is three to seven times an internal diameter of the cylindrical section of the outlet of the accelerator core.

4. The supersonic drive vacuum generator device according to claim 1, wherein the cylindrical section of the outlet of the accelerator core has a diameter that is between 2⅓ to 6½ times an inner diameter of the cylindrical section of the outlet of the accelerator core.

* * * * *